US006471791B1

(12) United States Patent
Nazmy et al.

(10) Patent No.: US 6,471,791 B1
(45) Date of Patent: Oct. 29, 2002

(54) COATING CONTAINING NIAL-β PHASE

(75) Inventors: Mohamed Nazmy, Fislisbach (CH); Hans Joachim Schmutzler, Maikammer (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/573,869

(22) Filed: May 18, 2000

(30) Foreign Application Priority Data

Jun. 8, 1999 (DE) ..... 199 26 669

(51) Int. Cl.[7] ..... C22C 19/03; C22C 19/05; C23C 30/00

(52) U.S. Cl. ..... 148/429; 148/428; 420/445; 420/460

(58) Field of Search ..... 148/429, 428; 420/460, 445

(56) References Cited

U.S. PATENT DOCUMENTS

| | | | | |
|---|---|---|---|---|
| 2,542,962 | A | 2/1951 | Kinsey | 75/170 |
| 3,904,403 | A | 9/1975 | Komatsu et al. | 75/170 |
| 4,045,255 | A | 8/1977 | Jackson | 148/32 |
| 4,116,723 | A | 9/1978 | Gell et al. | 148/3 |
| 4,451,431 | A | 5/1984 | Naik | 420/588 |
| 4,478,791 | A | 10/1984 | Huang et al. | 420/590 |
| 4,612,165 | A | 9/1986 | Liu et al. | 420/459 |
| 5,043,138 | A | 8/1991 | Darolia et al. | 420/443 |
| 5,116,438 | A | 5/1992 | Darolia et al. | 148/404 |
| 5,116,691 | A | 5/1992 | Darolia et al. | 428/614 |
| 5,215,831 | A | 6/1993 | Darolia et al. | 428/614 |
| 5,516,380 | A | 5/1996 | Darolia et al. | 148/404 |
| 6,153,313 | A | * 11/2000 | Rigney et al. | 428/632 |

FOREIGN PATENT DOCUMENTS

| | | |
|---|---|---|
| DE | 4423118 C1 | 6/1995 |
| EP | 0 207 874 | 1/1987 |
| WO | WO82/00477 | 2/1982 |
| WO | 99/02745 | 1/1999 |

OTHER PUBLICATIONS

"NiAl for Turbine Airfoil Application", Darolia, Structural Intermetallics, 1993, pp. 495–504.

* cited by examiner

*Primary Examiner*—Roy King
*Assistant Examiner*—Harry D. Wilkins, III
(74) *Attorney, Agent, or Firm*—Burns, Doane, Swecker & Mathis, L.L.P.

(57) ABSTRACT

The invention relates to a coating which contains large volumetric fractions, preferably from 20 to 90% by volume, of NiAl-β phase in a γ matrix. It contains the following microalloying elements which increase the ductility of the coating (data in % by weight): 0.1–8 Fe and/or 0.1–8 Mo and/or 0.1–8 Ga, where the total Fe, Mo and Ga content is at most 10%. In addition, small amounts of Zr, C and/or B may be added to the alloy, strengthening the β/γ phase boundaries.

21 Claims, 8 Drawing Sheets

COATING CONTAINING NIAL-β PHASE

FIELD OF THE INVENTION

The invention relates to the field of materials science. It relates to a coating which contains large volumetric quantities, preferably in the range from 20 to 90% by volume, of NiAl-β phase in a γ matrix.

BACKGROUND OF THE INVENTION

A large number of alloys which are used to coat gas turbine components, for example, are known. The gas turbine components, for example, turbine blades, are exposed to high temperatures and are to be protected from oxidation and corrosion by means of the coatings.

In order to fully exploit the advantage of a high temperature in order to increase the efficiency of the turbine and the excellent mechanical properties of the base material (for example single crystals or directionally solidified microstructures), it is necessary for the coating material not only to protect the base material against oxidation and corrosion but also not to impair the mechanical properties of the base material. In particular, a low ductile brittle transition temperature (DBTT) and consequently a certain ductility at low temperatures for the coating material are to be achieved.

Unfortunately, this is not the case with known coatings.

For example, U.S. Pat. No. 5,043,138 describes a coating which is a typical Ni-base superalloy (single crystal alloy) with the addition of yttrium and silicon. Although these elements improve the creep rupture strength and, moreover, lead to a low ductile brittle transition temperature, the other elements which it contains, namely W, Mo and the small amounts of Cr and Co have an adverse effect on the resistance to oxidation.

Although the high-strength NiAl alloys which have been developed in recent years are in certain ways able to compete with the Ni-base superalloys, they have the drawbacks of a low toughness compared to ductile, high-toughness Ni-base superalloys and a high DBT temperature (R. Dariola: NiAl for Turbine Airfoil Application, Structural Intermetallics, The Minerals, Metals & Materials Society, 1993, pp. 495–504), which is reflected by a low ductility of these alloys at low temperatures. The β phase of the NiAl alloys has an ordered cubic B2 crystal structure (CsCI Prototype) and comprises two simple cubic cells which penetrate one another and in which the Al atoms occupy the cube corners of one sublattice and the Ni atoms occupy the cube corners of the other sublattice. The β phase is coarse and therefore brittle.

U.S. Pat. No. 5,116,438 has disclosed β-phase Ni aluminides which are microalloyed with gallium. With about 0.25 atom % Ga, they exhibit a significant improvement in the ductility at room temperature. A higher Ga content has adverse effects.

The addition of small quantities of boron, and Hf, Zr, Fe and combinations of these elements, to $Ni_3Al$ alloys in order to improve the ductility is known, for example, from U.S. Pat. No. 4,478,791 and U.S. Pat. No. 4,612,165.

SUMMARY OF THE INVENTION

The invention improves the ductility of NiAl coatings which have a high content of β phase in a γ matrix. The β phase may have various compositions, for example NiAl, NiAlCr, NiAlMo, NiAlTi.

According to one aspect of the invention, this is achieved by the fact that the coating containing NiAl-β phase contains the following microalloying elements (data in % by weight) 0.1–8 Fe and/or 0.1–8 Mo and/or 0.1–8 Ga, where the total Fe, Mo and Ga content is at most 10%.

Advantages of the invention are that the ductility of the coating is significantly improved. The microalloying with Fe, Ga and Mo results in the β phase becoming finer and consequently in the ductility increasing, without the resistance to oxidation being reduced. If the ranges indicated are exceeded, there will be unfavorable consequences for the ductility and the resistance to oxidation and corrosion.

It is particularly expedient if the coating contains max. 4% by weight Fe, Ga, Mo.

Furthermore, it is advantageous if, in addition, small amounts of B; (0.0005–0.9, preferably 0.001–0.5% by weight), Zr (0.0005–1.0, preferably 0.001–0.5% by weight), and/or C; (0.0005–0.8, preferably max. 0.5% by weight) are added. B, Zr and C; strengthen the grain boundaries and the β/γ phase boundaries.

BRIEF DESCRIPTION OF THE DRAWINGS

Preferred embodiments of the invention are illustrated in the accompanying drawings, in which.

DETAILED DESCRIPTION OF THE INVENTION

The invention is explained in more detail below with reference to exemplary embodiments and FIGS. 1 to 8.

The ductility-enhancing effect of the microalloy according to the invention on coating materials which contain large quantities of NiAl-β phase in a γ matrix was demonstrated on specimens which were produced by the material being melted and then forged to form a strip with a size of 7×2×35 $mm^3$ and contain approximately 40–70% by volume NiAl-β.

Three-point bending tests were carried out on these specimens at 200° C. The level of plastic deformation was determined, which represents a measure of the ductility of the coatings.

The following alloys (data in % by weight) were used as comparison material:

TABLE 1

| | Comparison alloys | | | | | | | | |
|---|---|---|---|---|---|---|---|---|---|
| | Ni | Cr | Co | Al | Y | Si | Hf | Ta | Re |
| VL 1 | Remainder | 13 | 24 | 12 | 0.3 | 1.2 | — | 0.5 | 3 |
| VL 2 | Remainder | 13 | 30 | 11.5 | 0.3 | 1.2 | — | 0.5 | — |
| VL 3 | Remainder | 22 | 35 | 10 | 1 | — | — | — | — |

Table 1: Comparison alloys

According to the invention, the comparison alloys VL 1, VL 2 and VL 3 were microalloyed with Zr, B and Fe. In detail, the following alloys (data in % by weight) were produced, on which the plastic deformation was likewise determined using a three-point bending test at 200° C.:

TABLE 2

| | Alloys according to the invention (modified comparison alloys) | | | |
|---|---|---|---|---|
| | According to Table 1 | Zr | B | Fe |
| L11 | VL 1 | 0.2 | 0.05 | 4 |
| L12 | VL 1 | 0.2 | — | 3 |
| L13 | VL 1 | 0.2 | — | 4 |
| L21 | VL 2 | 0.2 | — | 3 |
| L31 | VL 3 | 0.2 | — | 3 |

Table 2: Alloys according to the invention (modified comparison alloys)

Figure 1:
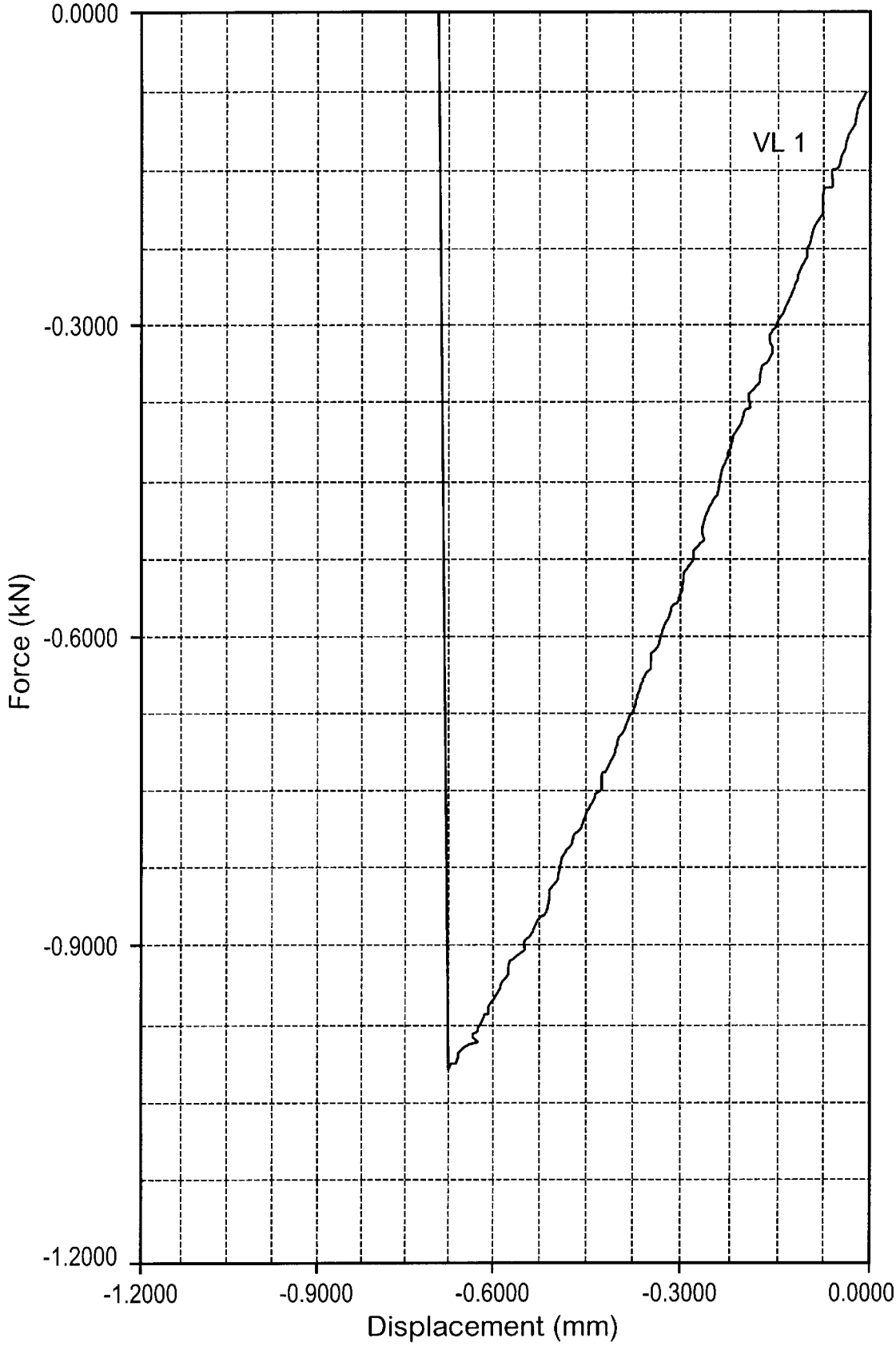
FIG. 1 shows a force-deflection diagram for an alloy of the priority.

FIG. 1 shows the force-deflection diagram for the comparison alloy VL 1 which is known from the prior art. The specimen presented only slight plastic deflection and fractured under the action of a force of approx. 1 kN.

Figure 2:
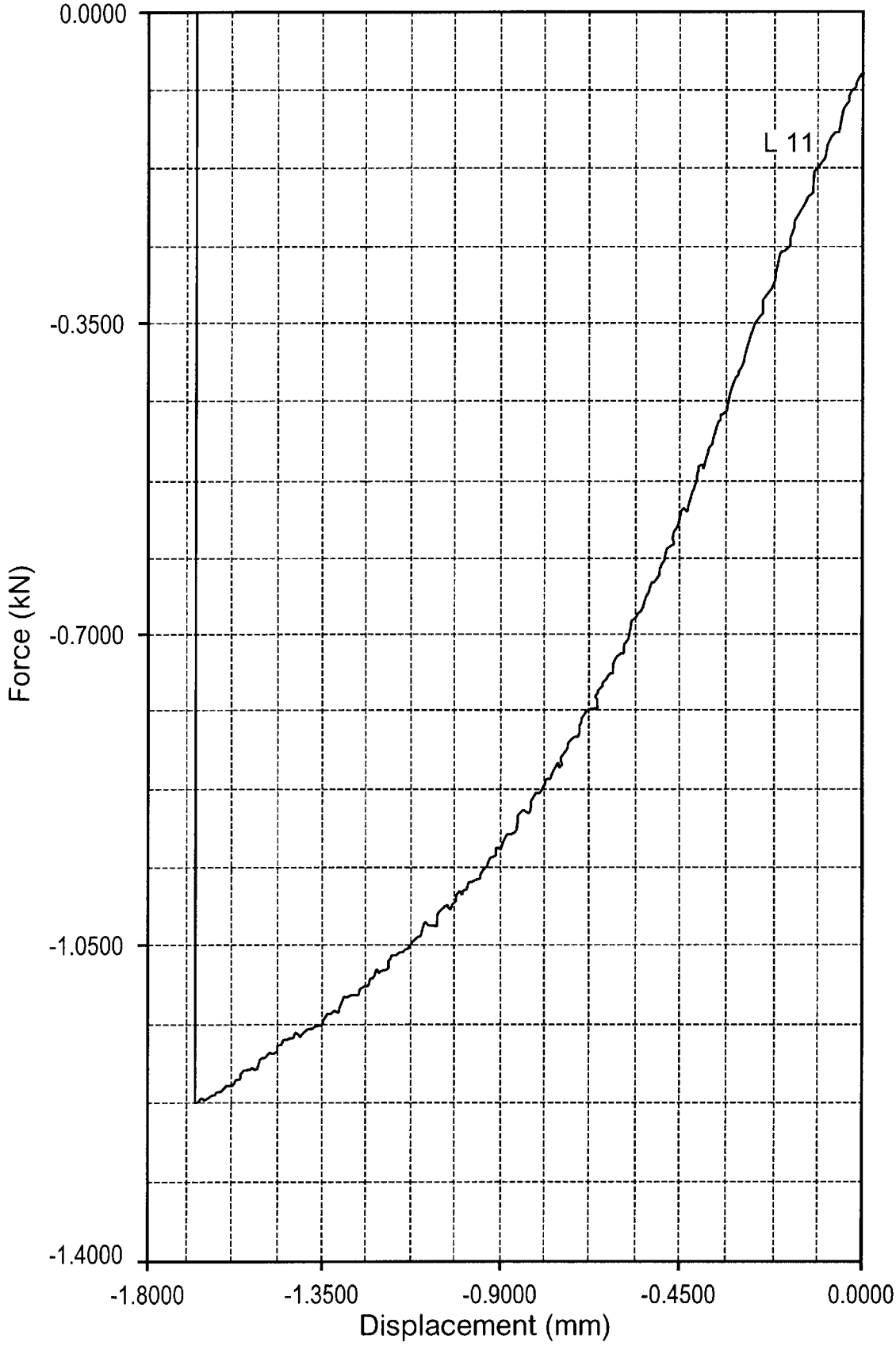
FIG. 2 shows a force-deflection diagram for an alloy according to a first embodiment of the invention.

FIG. 2 shows the force-deflection diagram of the alloy L 11 according to the invention (comparison alloy VL 1, microalloyed with 0.2% by weight Zr, 0.05% by weight B and 4% by weight Fe). Compared to VL 1, the specimen presented significantly greater plastic deflection and only fractured at approx. 1.2 kN.

While VL 1 has a ductile brittle transition temperature of over 300° C., the alloy L 11 has a significantly lower ductile brittle transition temperature (200° C.).

Figure 3:
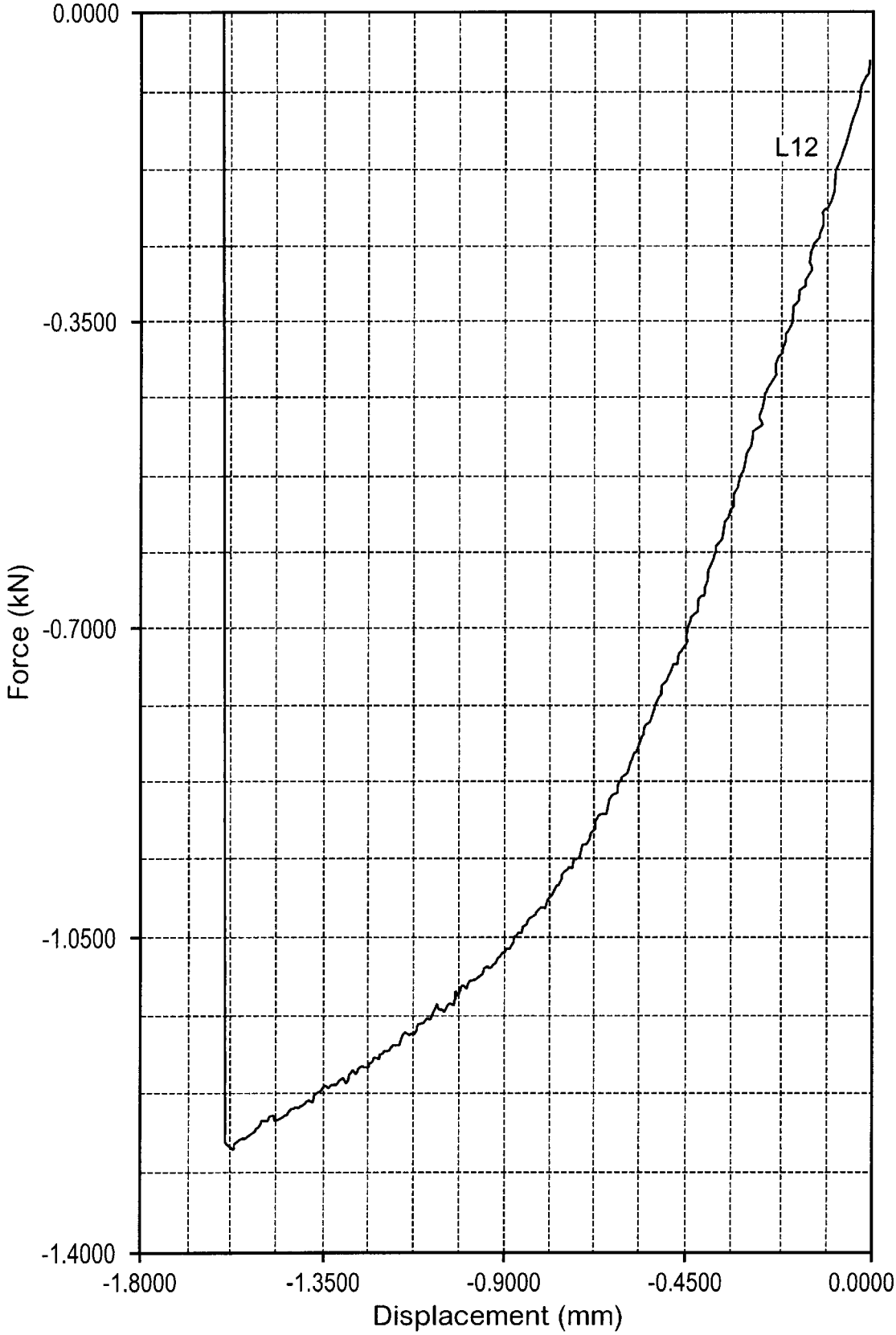
FIG. 3 shows a force-deflection diagram for an alloy according to a second embodiment of the invention.

If the alloy L 12 is used (composition as L 11, but without the addition of boron and with only 3% by weight Fe), the force-deflection diagram shown in FIG. 3 reveals that, compared to FIG. 2, the plastic deflection was slightly lower, but on the other hand the force at which the specimen fractured was slightly higher, at approx. 1.3 kN.

Figure 4:
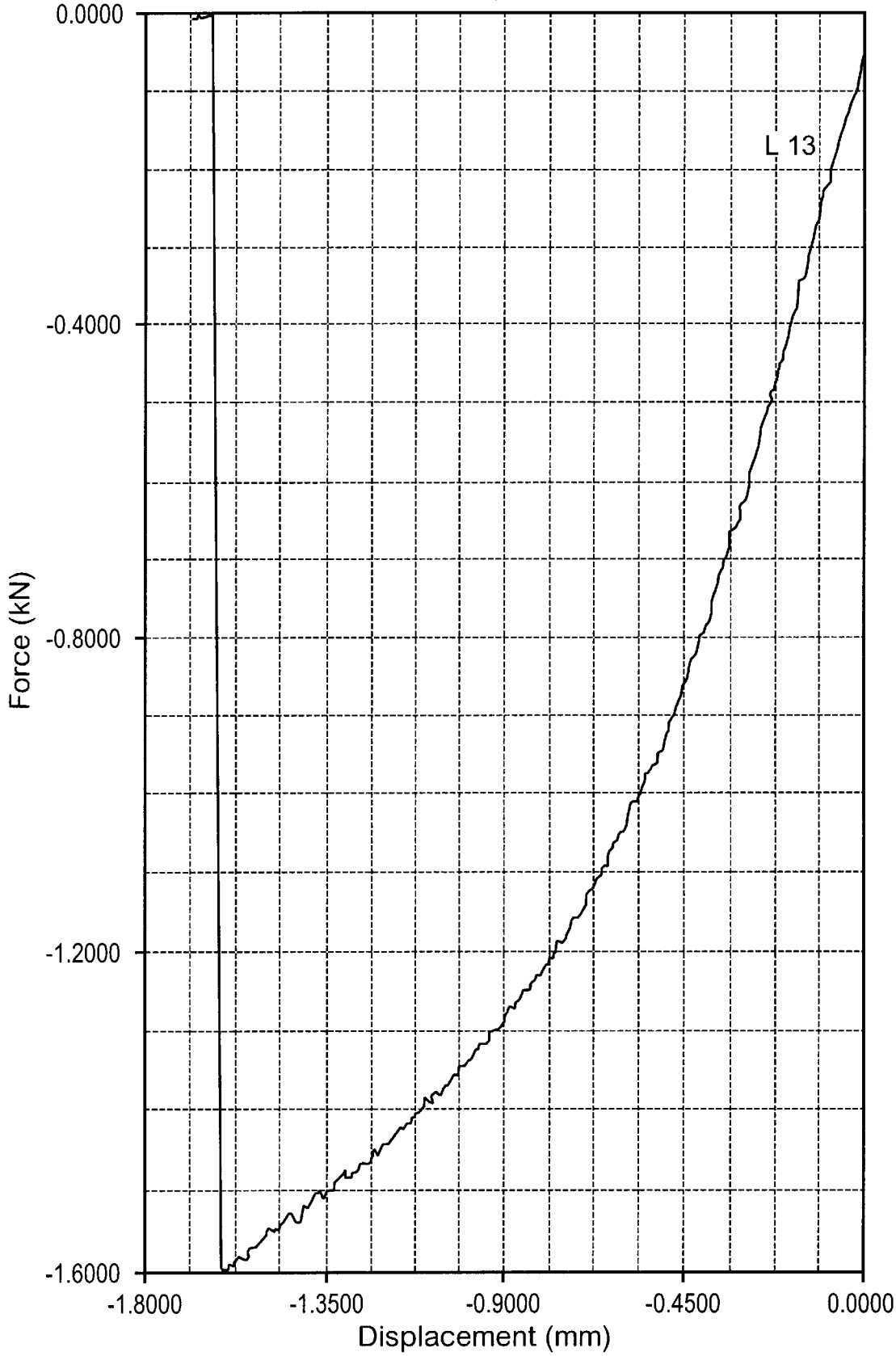
FIG. 4 shows a force-deflection diagram for an alloy according to a third embodiment of the invention.

FIG. 4 shows the force-deflection diagram for the alloy L 13 (composition as L 12, but 4% by weight Fe). The plastic deflection is in this case slightly higher again, the fracture force amounting to approx. 1.8 kN.

Therefore, by microalloying with Fe, Zr and B it is thus possible to increase the ductility of the coatings containing NiAl-β phase. The microalloying elements make the coarse β phase finer. B, Zr and C strengthen the grain boundaries and the β/γ phase boundaries.

The influence of the microalloying elements Zr and Fe on the ductility of the comparison alloy VL 2 was found to be even more significant.

Figure 5:
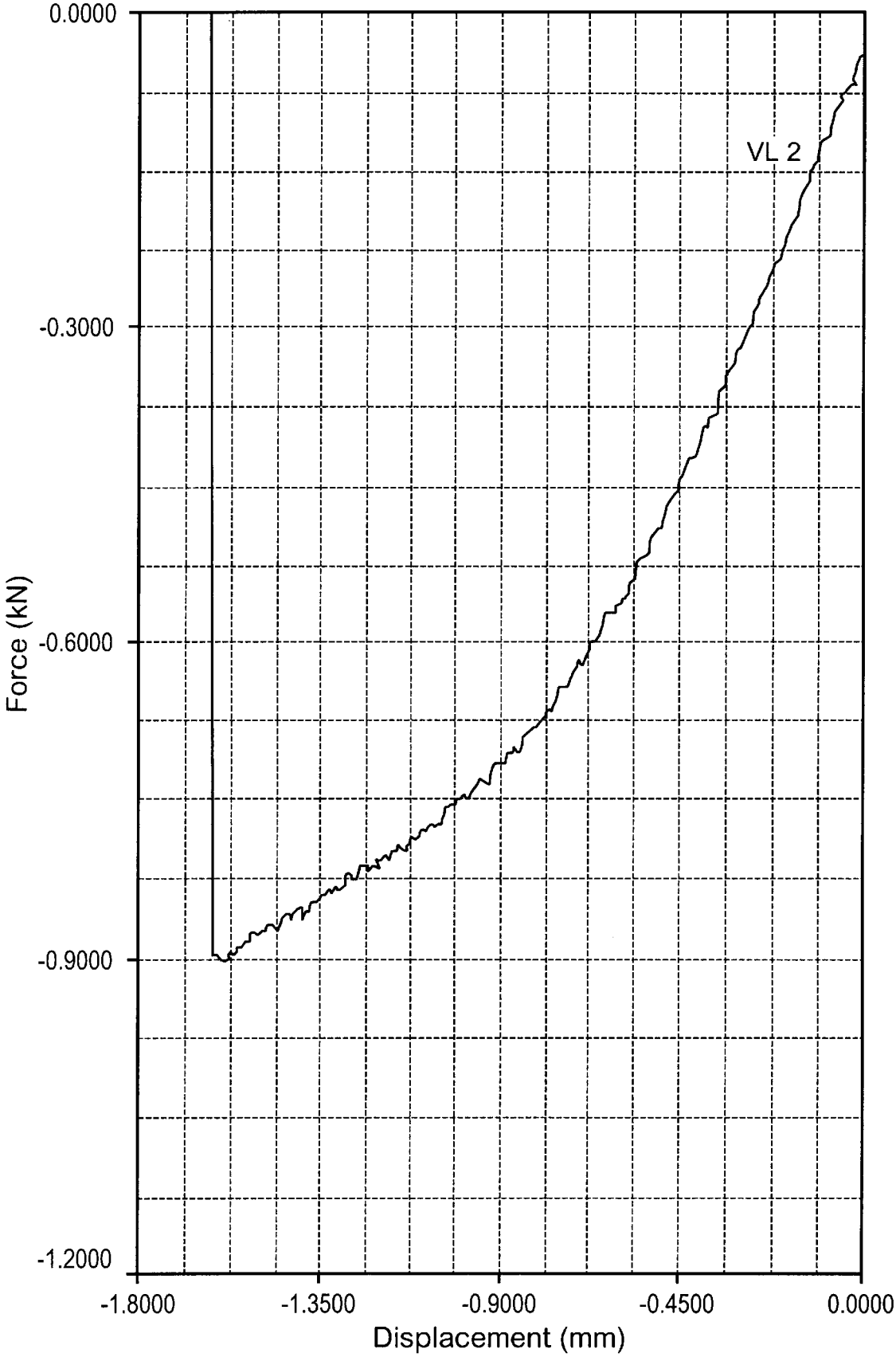
FIG. 5 shows a force-deflection diagram for an alloy according to priority art.
Figure 6:
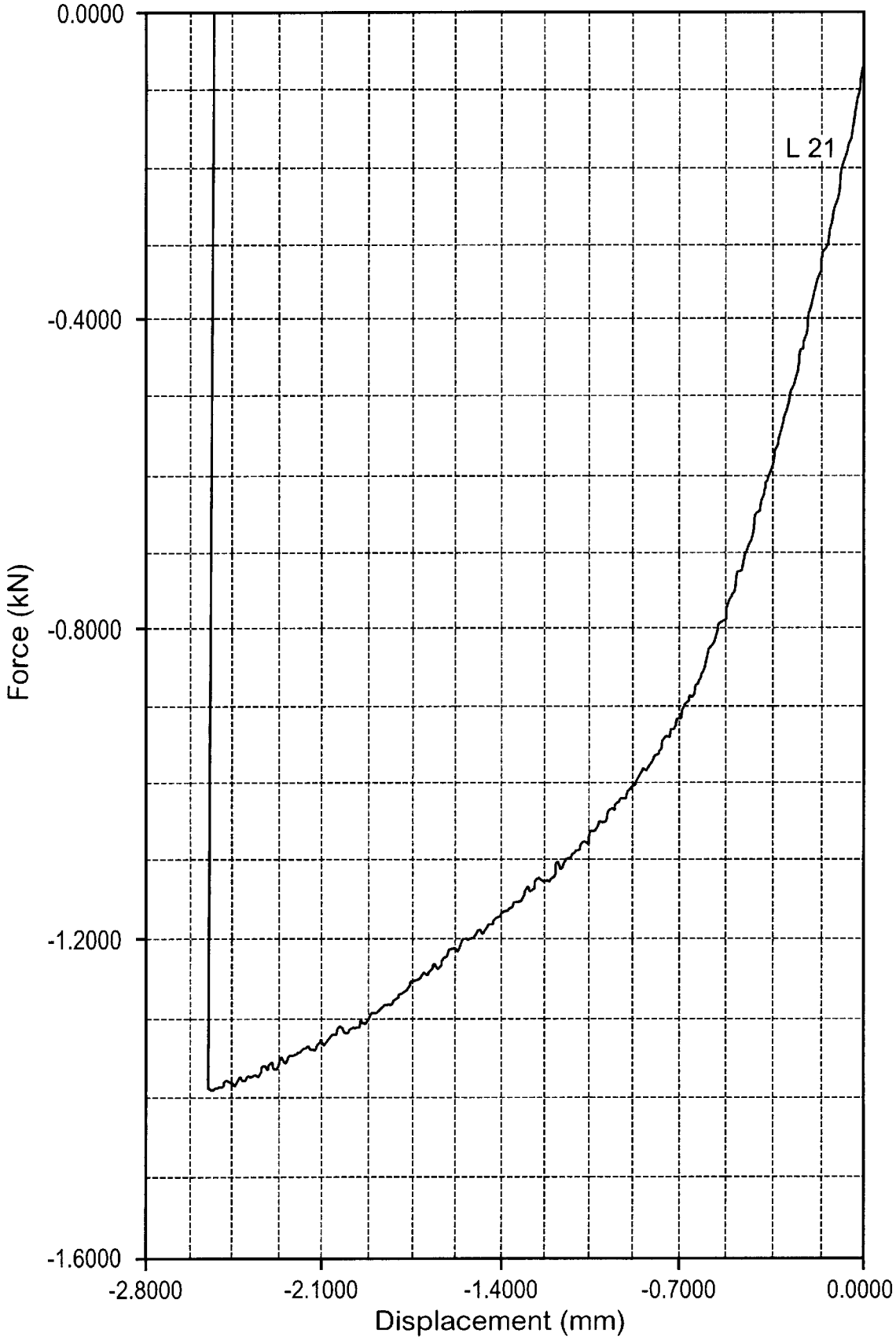
FIG. 6 shows a force-deflection diagram for an alloy according to in a further embodiment of the invention.

As shown in FIG. 5, during the three-point bending test, the specimen fractured under the action of a force of approx. 0.9 kN, with a deflection of approximately 1.65 mm.

By contrast, if the alloy according to the invention L 21 (=VL 2+0.2% by weight Zr+3% by weight Fe) is investigated in the three-point bending test (FIG. 6), the plastic deflection can be increased significantly. Fracture only occurred under a force of approx. 1.4 kN, and the deflection of the specimen was approx. 2.5 mm.

Figure 7:
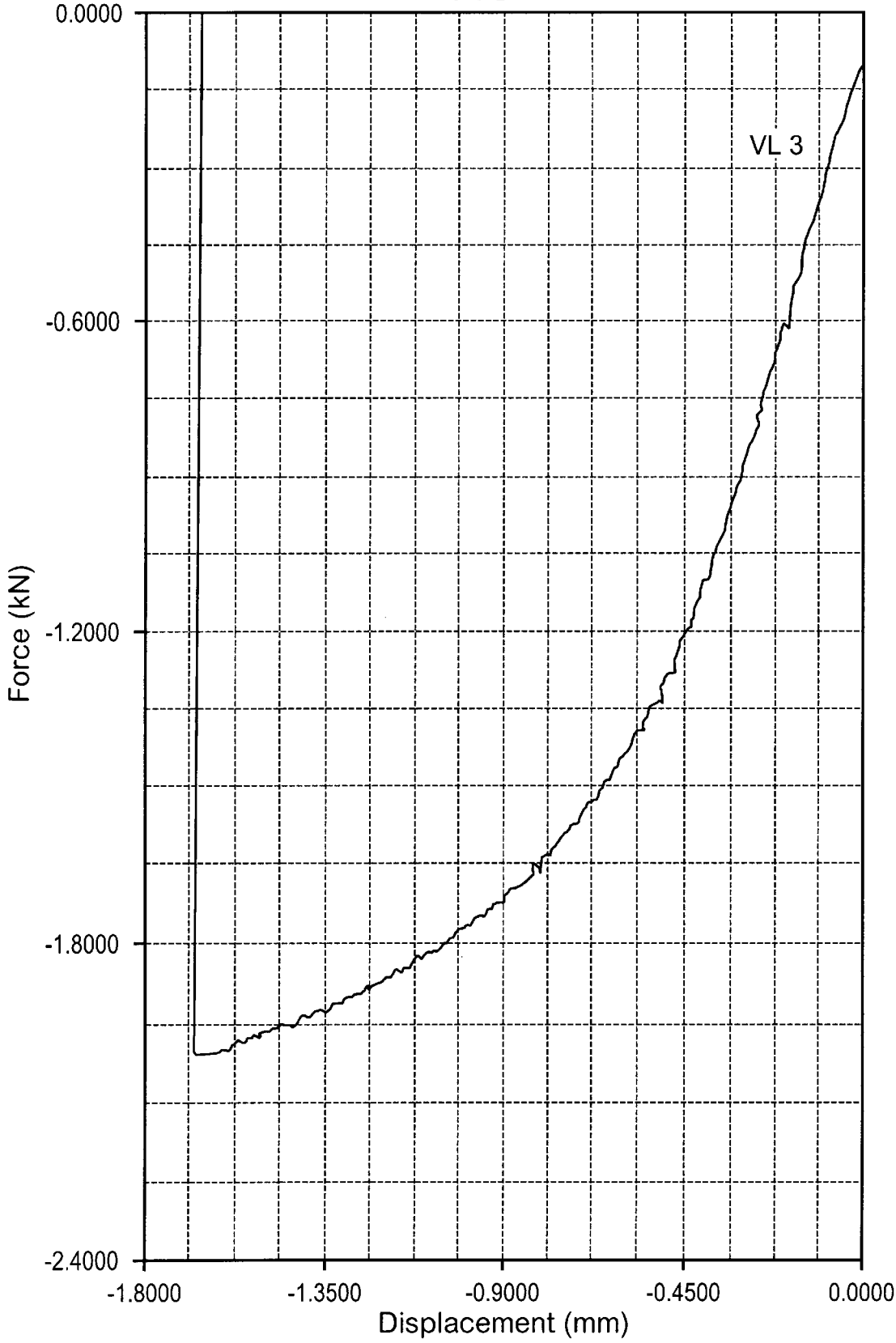
FIG. 7 shows a force-deflection diagram for an alloy of the prior art.
Figure 8:
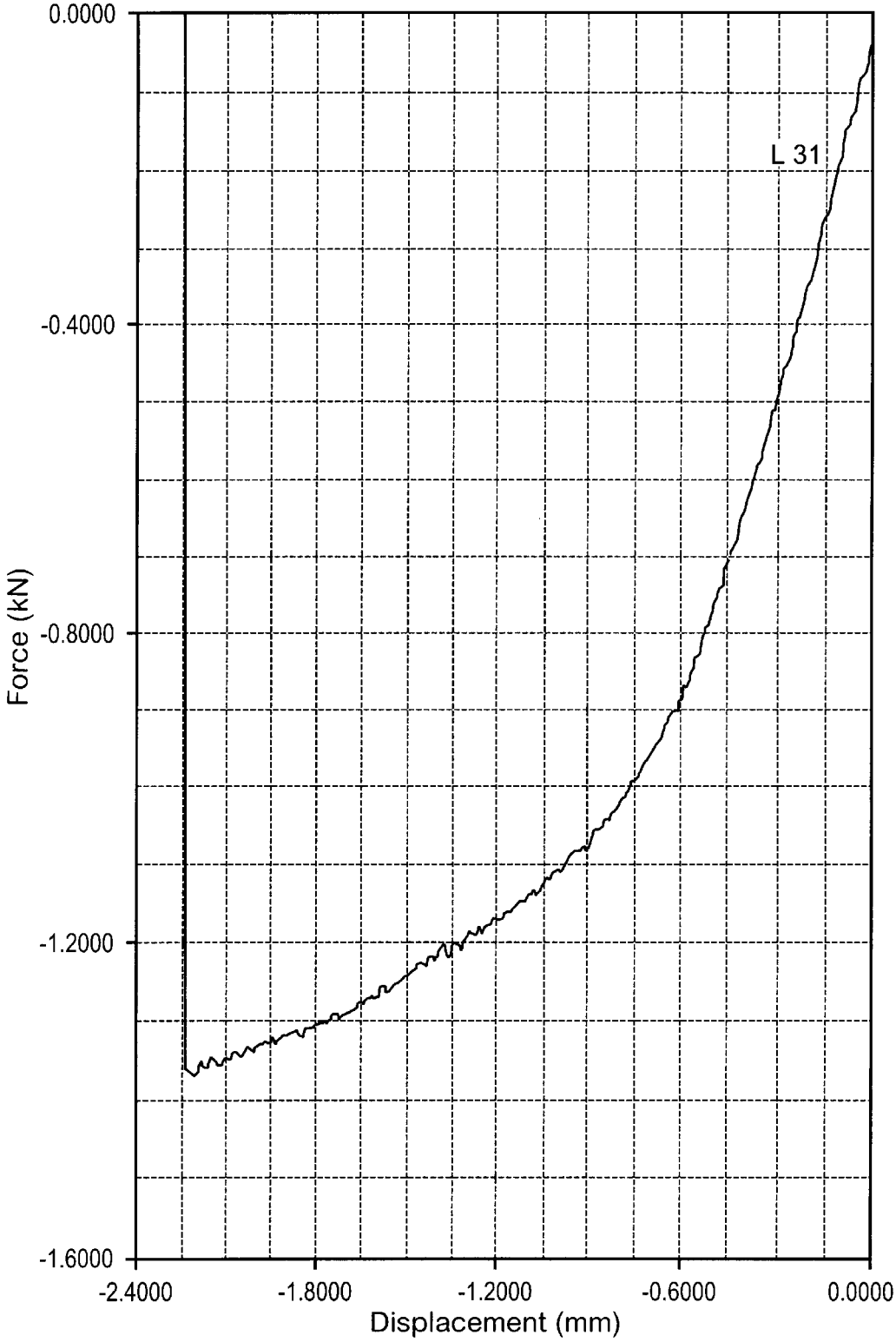
FIG. 8 shows a force-deflection diagram for an alloy according to yet another embodiment of the invention.

A further exemplary embodiment of the invention is illustrated in FIGS. 7 and 8. The comparison alloy VL 3 fractured under the action of a force of approx. 2 kN, with a deflection of 1.7 mm, while the alloy according to the invention L 31, which differs from VL 3 in that it is additionally microalloyed with 3% by weight Fe and 0.2% by weight Zr, presented deflection of approx. 2.2 mm at the fracture point. It was thus possible for the plastic deformation and therefore the ductility of the coating alloy to be increased significantly by the addition of these additional elements. The fact that the NiAl phase was made more ductile makes the crack propagation slower, i.e. the fracture toughness is increased, which has a positive effect on the performance of the coatings under load.

Naturally, the invention is not limited to the exemplary embodiments described. It can be applied to all coatings which contain β-phase NiAl. Fe, Mo and Ga may each be added to the alloy in a range from 0.1 to 8, preferably 4% by weight. The elements may be added either individually or in combination, although a total content of at most 10% by weight should not be exceeded. The abovementioned elements make the β phase finer and consequently increase the ductility without reducing the resistance to oxidation. If the ranges indicated are exceeded, there will be adverse consequences for the ductility and the resistance to oxidation and corrosion.

As well as the addition of Zr and B which is described in the exemplary embodiments, it is also possible to add C to the alloy in order to strengthen the β/γ phase boundaries. The addition of 0.0005 to 0.9, preferably 0.001 to 0.5% by weight B, 0.0005 to 1.0, preferably 0.001 to .0.5% by weight Zr and 0.0005 to 0.8% by weight C is envisaged. The elements B, C and Zr, which strengthen the phase boundaries, may be added individually or in combination.

While the present invention has been described by reference to the above described embodiments, certain modifications and variations will be evident to those of ordinary skill in the art. Therefore, the present invention is to be limited only by the scope and spirit of the appended claims.

What is claimed is:

1. A coating containing NiAl-β phase, with an NiAl-β content in the range from 20 to 90% by volume in a γ matrix, which contains Fe and optionally at least one of Mo and Ga as microalloying elements, in % by weight: 3–8 Fe, 0.1–8 Mo and 0.1–8 Ga, where the total Fe, Mo and Ga content is at most 10%.

2. The coating containing NiAl-β phase as claimed in claim 1, comprising, in % by weight; 3–4 Fe and/or 0.1–4 Mo and/or 0.1–4 Ga.

3. The coating containing NiAl-β phase as claimed in claim 1, comprising 0.0005–1.0% by weight Zr.

4. The coating containing NiAl-β phase as claimed in claim 3, comprising 0.001–0.5% by weight Zr.

5. The coating containing NiAl-β phase as claimed in claim 3, comprising 0.2% by weight Zr.

6. The coating containing NiAl-β phase as claimed in claim 3, comprising in weight %: 13 Cr, 24 Co, 12 Al, 0.3 Y, 1.2 Si, 0.5 Ta, 3 Re, 0.2 Zr, 0.05 B, 4 Fe, remainder Ni.

7. The coating containing NiAl-β phase as claimed in claim 3, comprising in % by weight; 13 Cr, 24 Co, 12 Al, 0.3 Y, 1.2 Si, 0.5 Ta, 3 Re, 0.2 Zr, 4 Fe, remainder Ni.

8. The coating containing NiAl-β phase as claimed in claim 3, comprising in % by weight; 13 Cr, 24 Co, 12 Al, 0.3 Y, 1.2 Si, 0.5 Ta, 3 Re, 0.2 Zr, 3 Fe, remainder Ni.

9. The coating containing NiAl-β phase as claimed in claim 3, comprising, in % by weight; 13 Cr, 30 Co, 11.5 Al, 0.3 Y, 1.2 Si, 0.5 Ta, 0.2 Zr, 3 Fe remainder Ni.

10. The coating containing NiAl-β phase as claimed in claim 3, comprising in % by weight; 22 Cr, 35 Co, 10 Al, 1 Y, 0.2 Zr, 3 Fe, remainder Ni.

11. The coating containing NiAl-β phase as claimed in claim 1, comprising 0.0005–0.9% by weight B.

12. The coating containing NiAl-β phase as claimed in claim 11, comprising 0.001–0.5% by weight B.

13. The coating containing NiAl-β phase as claimed in claim 11, comprising 0.2% by weight B.

14. The coating containing NiAl-β phase as claimed in claim 1, comprising 0.0005–0.8% by weight C.

15. The coating containing NiAl-β phase as claimed in claim 14, comprising 0.5% by weight C.

16. The coating containing NiAl-β phase as claimed in claim 1, the NiAl-β phase comprising NiAl, NiAlCr, NiAlMo and/or NiAlTi.

17. The coating containing NiAl-β phase as claimed in claim 1, comprising 0.0005 to 0.9% by weight B, 0.0005 to 1.0% by weight Zr, and 0.0005 to 0.8% by weight C.

18. The coating containing NiAl-β phase as claimed in claim 1, with an NiAl-β content in the range from 40 to 70% by volume in the γ matrix.

19. The coating containing NiAl-β phase as claimed in claim 1, comprising B, Zr and/or C in an amount effective to strengthen grain boundaries and β/γ phase boundaries of the alloy.

20. The coating containing NiAl-β phase as claimed in claim 1, comprising up to 4 weight % total of the Fe, Mo and Ga, the microalloying elements being effective to reduce grain size of the NiAl β-phase and increase ductility of the NiAl-β phase.

21. The coating containing NiAl-β phase as claimed in claim 1, wherein the coating does not include Mo as one of the microalloying elements.

* * * * *